United States Patent [19]

Fatula

[11] 4,292,767

[45] Oct. 6, 1981

[54] BELT GRINDER FOR GRINDING NON-CIRCULAR WORKPIECE

[75] Inventor: James J. Fatula, New Beaver, Pa.

[73] Assignee: Ryman Engineering Company, Elwood City, Pa.

[21] Appl. No.: 117,808

[22] Filed: Feb. 1, 1980

[51] Int. Cl.[3] ..... B24B 21/16

[52] U.S. Cl. ..... 51/145 R

[58] Field of Search ..... 51/135 R, 145

[56] References Cited

U.S. PATENT DOCUMENTS 2,386,850 10/1945 Gaudreau ..... 51/145 R X 4,091,573 5/1978 Schmidt ..... 51/145 R

*Primary Examiner*—Harold D. Whitehead

*Attorney, Agent, or Firm*—Martin J. Carroll

[57] ABSTRACT

A belt grinder for grinding a rotating non-circular work piece includes three rotatable rolls around which an abrasive belt moves. The rolls are arranged in a triangular manner with one of the rolls being the work roll which is slidably mounted toward and away from the workpiece. Resilient means applies a force to urge the work roll in the direction of the workpiece with the force increasing as the work roll moves toward the axis of the workpiece.

10 Claims, 11 Drawing Figures

BELT GRINDER FOR GRINDING NON-CIRCULAR WORKPIECE

This invention relates to a belt grinder and more particularly to a belt grinder for grinding the surface of a workpiece rotating on a longitudinal axis and having a non-circular cross-section. It is common to have a belt grinder including three rolls arranged in a triangular manner with their axes substantially parallel and with one of the rolls being the contact or work roll. Such grinders work well when grinding a workpiece having a circular cross-section with the workpiece being mounted for rotation on its longitudinal axis which is substantially parallel to the axis of the work roll. In grinding workpieces having a non-circular cross-section the work roll must be slidably mounted so that it will contact the surface of the workpiece at all times. The problem with this arrangement is that the grinding pressure decreases as the work roll moves outward due to abrasive belt tension forces on the pulley system, whereas for proper grinding this pressure should generally increase. As a result the present practice, except for my invention, is to use hand tools to grind such workpieces. This is a costly and time consuming process. The accuracy of the grinding is also dependent upon the skill of the operator so that a highly skilled operator is needed to obtain a proper finish. For example, a fiber glass workpiece having a 12"×15" cross-section and about 5' long requires 16 man hours to grind whereas with the grinder of my invention it only requires 20 minutes with little physical effort by the workman. Prior to my invention I tried to use an air cylinder to directly urge the work roll against the workpiece, but this failed to do the job properly since in most cases damage to the corners resulted. Using a spring in place of the air cylinder also failed. I have found that by providing means for varying the pressure in opposition to the pressure exerted by the workpiece in a predictable manner proper grinding can be achieved. Although I have been engaged in the manufacture of belt grinders for many years I have not seen nor do I have knowledge of any belt grinder for grinding workpieces having a non-circular cross-section uniformly and/or predictably.

It is therefore an object of my invention to provide a belt grinder for grinding non-circular workpieces rapidly, uniformly and accurately.

Another object is to provide a belt grinder in which the pressure between the workpiece and belt can be varied in a predictable manner.

A further object is to provide such a machine which grinds the workpiece accurately without requiring a highly skilled operator.

These and other objects will be more apparent after referring to the following specification and attached drawings in which.

Figure 1:
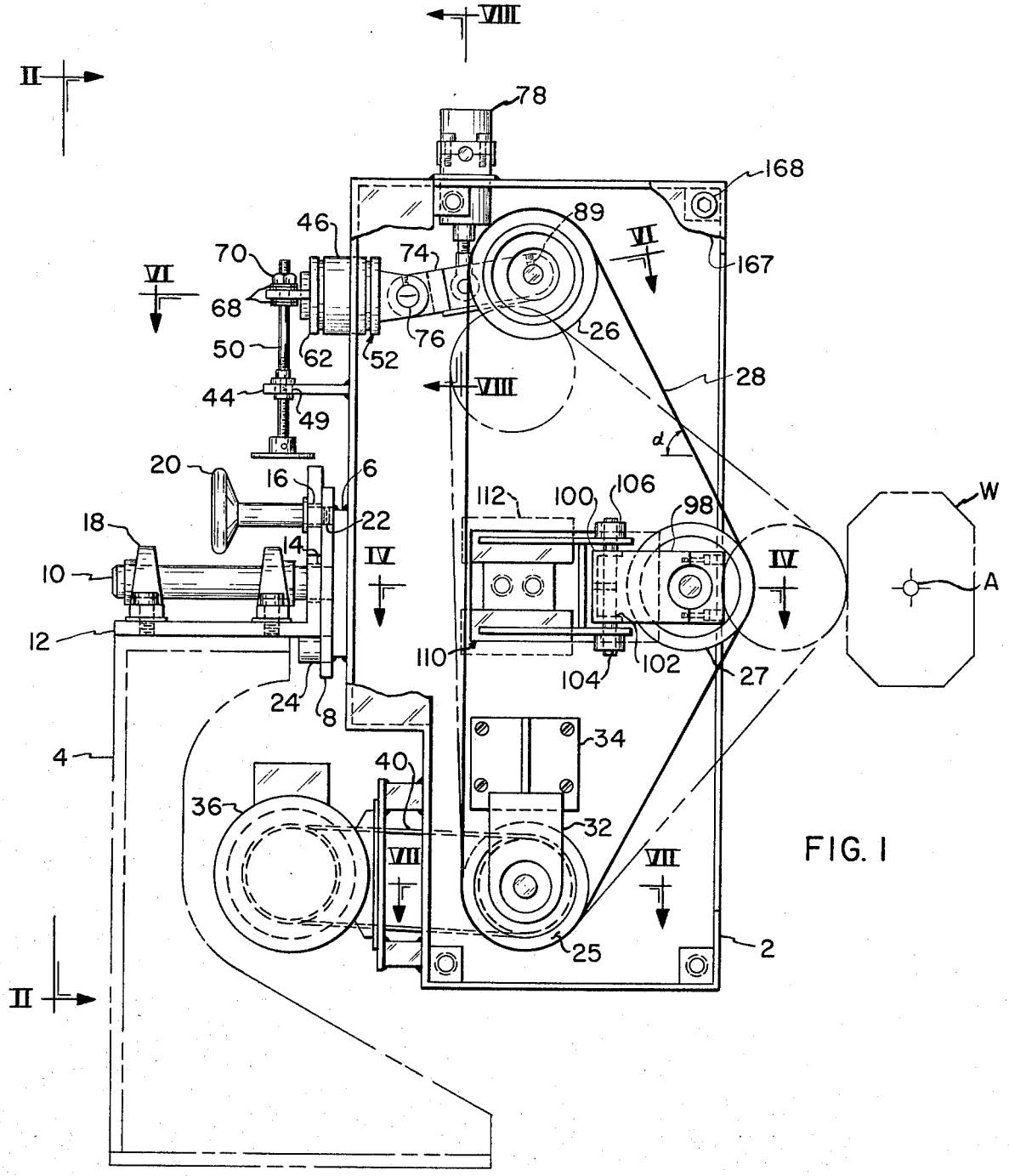
FIG. 1 is a side elevation of the belt grinder of my invention with the cover removed.

Referring more particularly to the drawings reference numeral 2 indicates the housing of my machine. The housing 2 is pivotally mounted on a base 4 in the following manner. The housing 2 has a plate 6 secured thereto as by welds and secured to plate 6 by welding or studs is a second plate 8 having a pivot shaft 10 welded thereto and extending outwardly horizontally from housing 2. An L-shaped bracket 12 is bolted to the top of base 4 and has a hole 14 for receiving shaft 10 and a slot 16 having a radius about the axis of hole 14. The bracket 12 supports a pair of spaced bearings 18 for supporting shaft 10. A pivot lock 20 passes through slot 16 and is the threaded into a threaded hole 22 in plate 8. The housing 2 is shown in its vertical position, but may be moved about the axis of shaft 10 by loosening pivot lock 20 and moving it the desired distance and again screwing the pivot lock 20 tightly into hole 22. A stop 24 mounted on plate 8 limits movement of the housing 2 to a horizontal position. This pivoted arrangement has the advantage that workpieces that lend themselves to grinding by traversing the workpiece rather than rotating it may be ground.

The belt grinder includes drive roll 25 idler roll 26 and work roll 27 around which passes on abrasive belt 28. The drive roll 25 and idler roll 26 are preferably rubber covered self-centering rolls of the type shown in Lorig U.S. Pat. Nos. 2,592,581 dated Apr. 15, 1952 or No. 2,772,879 dated Dec. 4, 1956.

Drive roll 25 is keyed to a shaft 28 and secured thereto by means of a set screw 29. The shaft 28 is mounted in bearings 30 supported in spaced arms 32 of a bracket 34 bolted to housing 2. The roll 25 is rotated from a motor 36 through a motor sheave 38, drive belt 40, and a sheave 42 secured to shaft 28.

Figure 2:
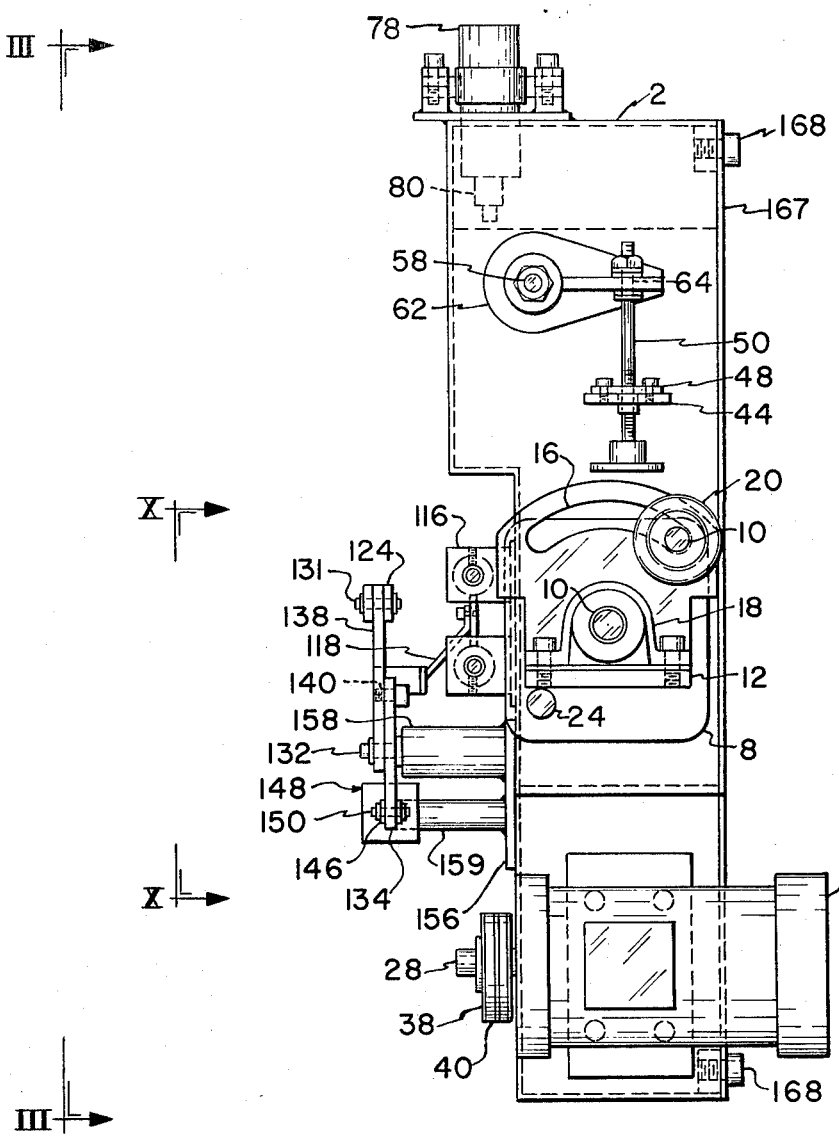
FIG. 2 is a view taken on line II—II of FIG. 1.
Figure 7:
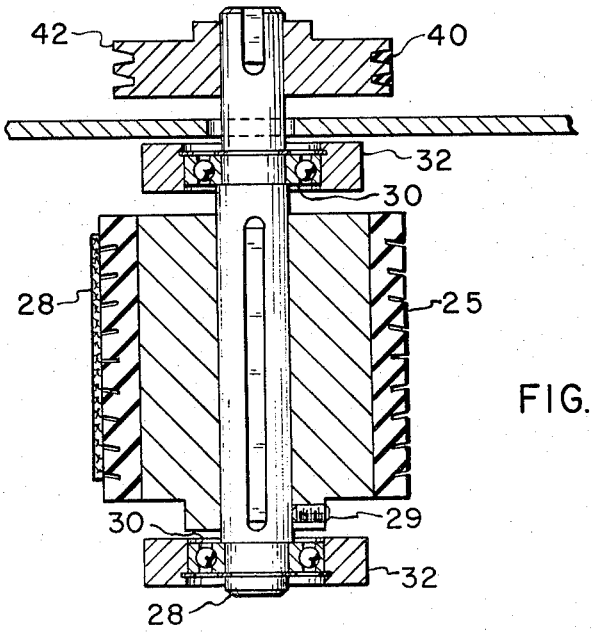
FIG. 7 is a view taken on line VII—VII of FIG. 1.
Figure 3:
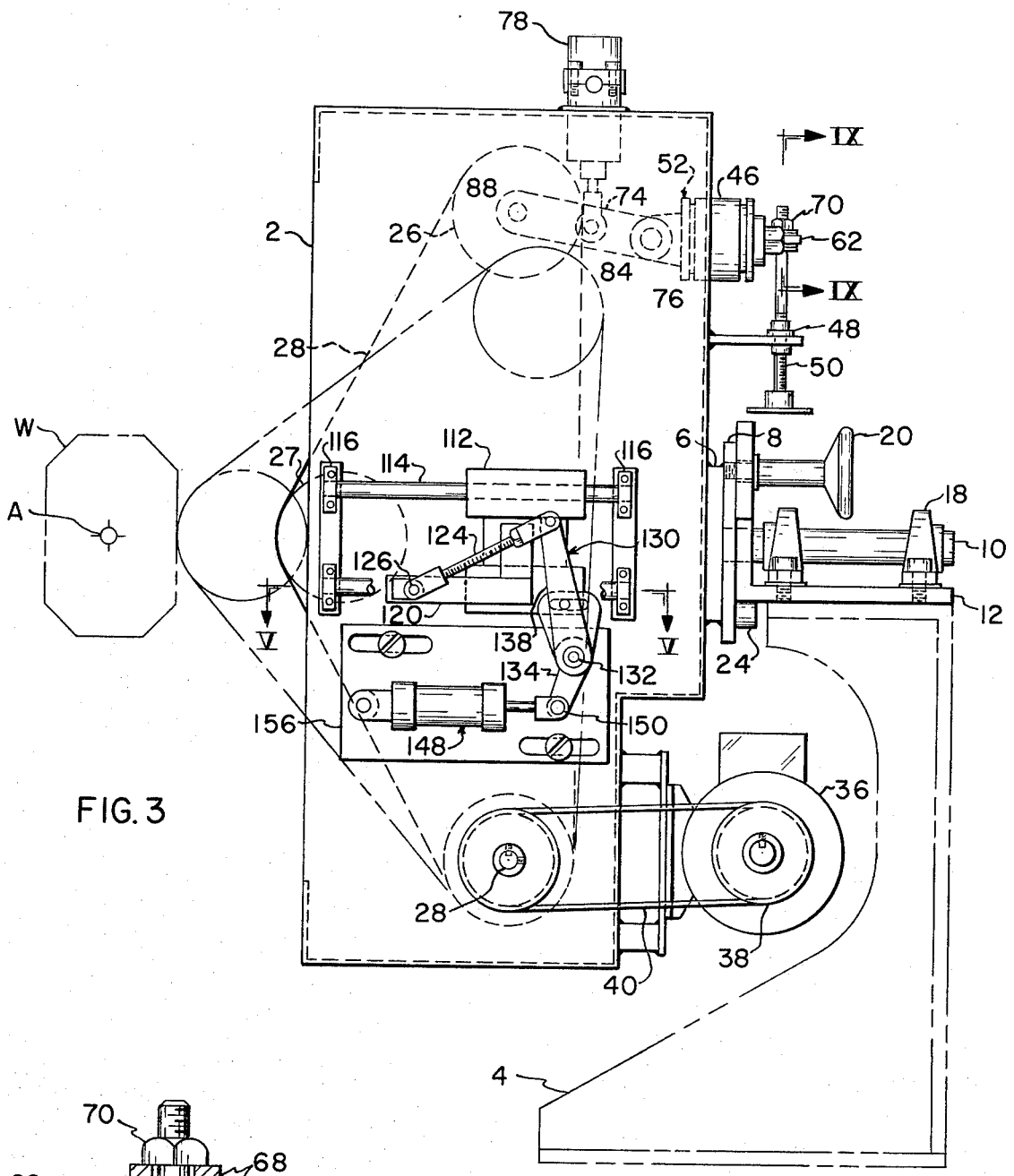
FIG. 3 is a view taken on line III—III of FIG. 2.
Figure 9:
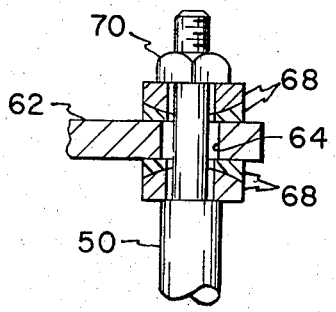
FIG. 9 is a view taken on line IX—IX of FIG. 3.
Figure 6:
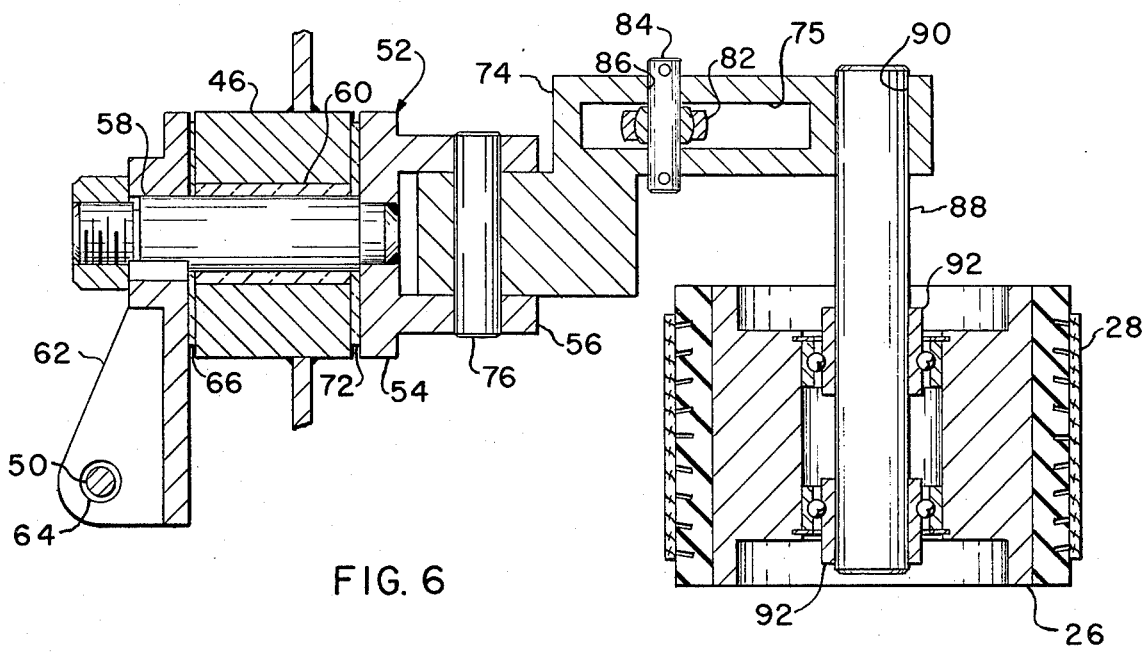
FIG. 6 is a view taken on line VI—VI of FIG. 1.
Figure 8:
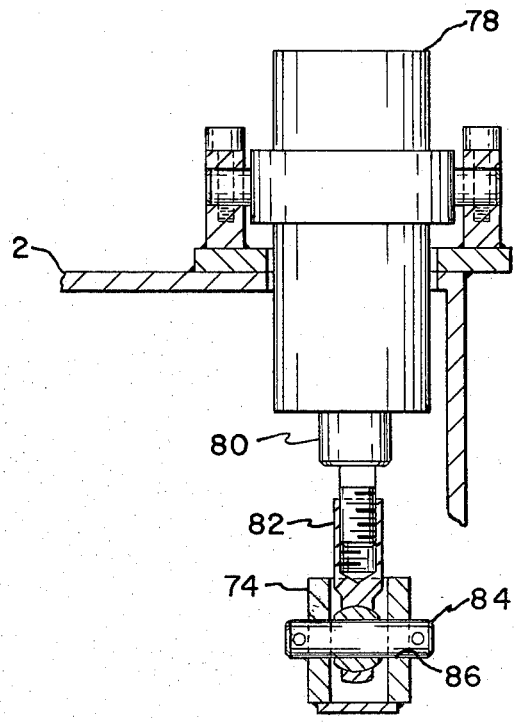
FIG. 8 is a view taken on line VIII—VIII of FIG. 1.

Idler roll 26 is preferably adjustably mounted on the housing 2 in the following manner. A flange 44 (FIG. 2) is secured to the housing 2 in vertically and horizontally spaced relationship with a sleeve 46 (FIG. 6) passing horizontally through the wall of housing 2. A nut 48 is secured to one side of flange 44 in alignment with a hole 49 therethrough and an adjusting screw 50 is threaded therethrough. A swivel 52 including a central collar 54, bifurcation 56 at one end, and a shaft 58 is arranged with its shaft 58 passing through a bushing 60 in sleeve 46 and with bifurcation 56 on the inside of housing 2. An arm 62 is keyed to shaft 58 and extends horizontally therefrom with a slot or oversized hole 64 therein for receiving screw 50. A thrust washer 66 is provided between sleeve 46 and arm 62 and spherical washers 68 (FIG. 9) are provided around screw 50 on each side of arm 62 with a nut 70 bearing against the top washer 68. A thrust washer 72 (FIG. 6) is provided between sleeve 46 and collar 54. An arm 74 having an opening 75 therein is pivotally mounted on a pin 76 passing through holes in the bifurcations 56. An air cylinder 78 (FIG. 3) is mounted on the top of housing 2 with its piston rod 80 extending vertically downward with a clevis 82 at its lower end extending into opening 75. A pin 84 (FIG. 6) extending through hole in the clevis 82 and holes 86 in arm 74 forms a pivot connection. A shaft 88 has one end secured by set screw 89 in hole 90 at the free end of arm 74 and idler roll 26 is rotatably mounted thereon by means of bearings 92. The tension on the belt 28 may be varied by raising or lowering the roll 26 by means of air cylinder 78. The axes of rolls 25, 26 and 27 are substantially parallel, but the axis of roll 26 may be slightly varied with respect to the axes of the other rolls for better alignment and tracking by operation of adjusting screw 50. This general type of adjustment is broadly old.

Figure 4:
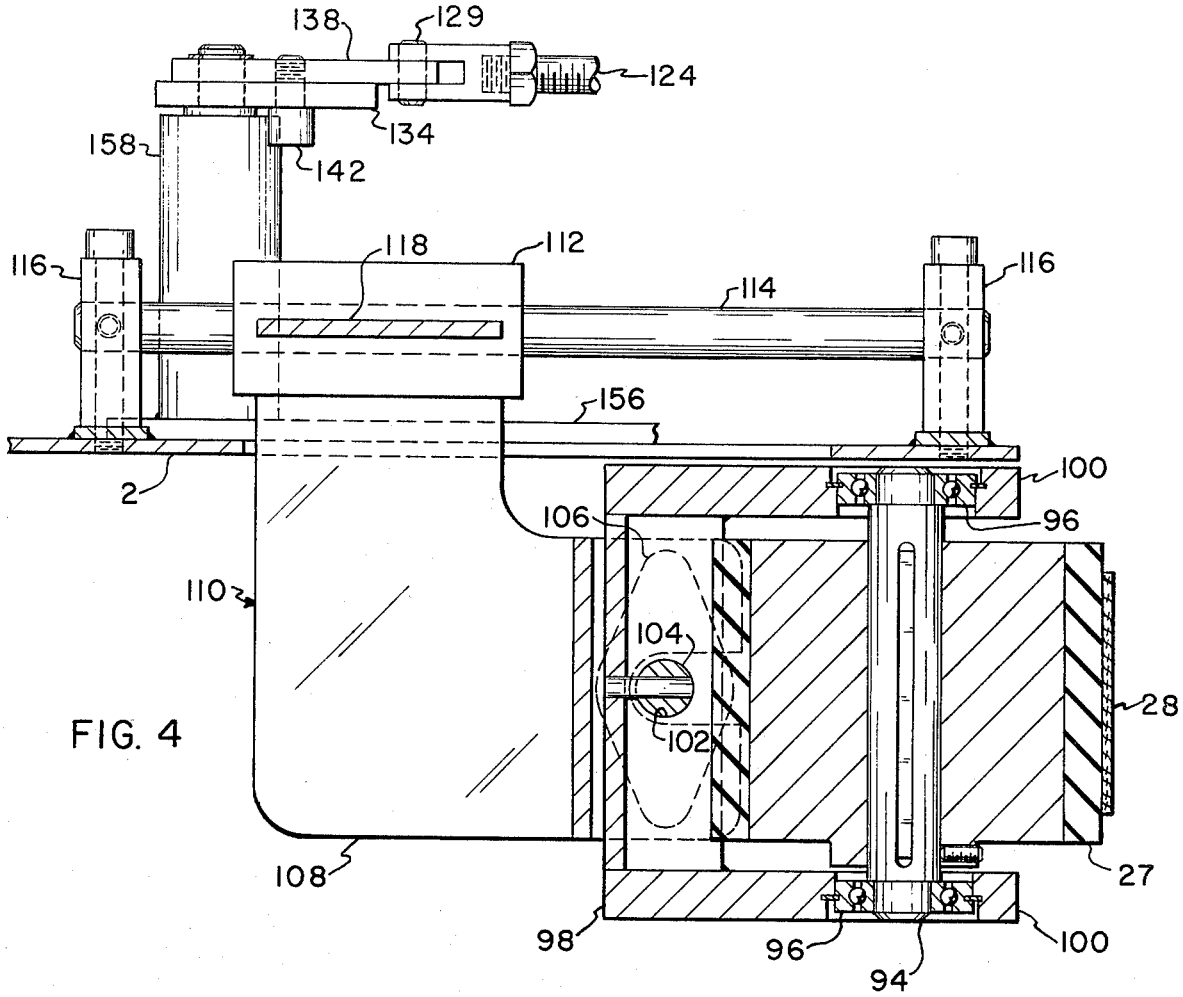
FIG. 4 is a view taken on line IV—IV of FIG. 1.
Figure 5:
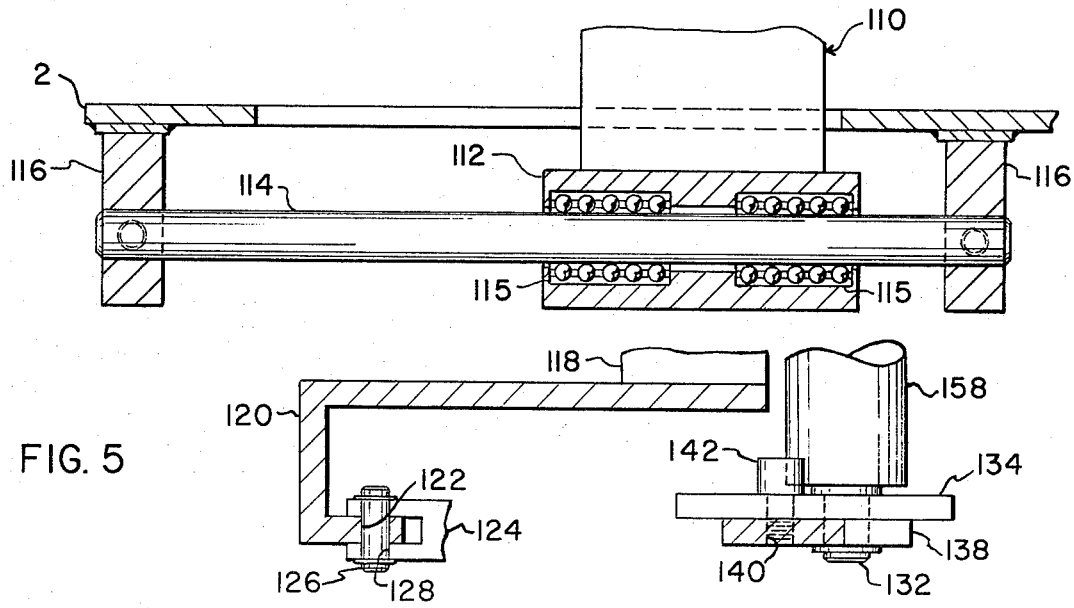
FIG. 5 is a view taken on line V—V of FIG. 3.
Figure 10:
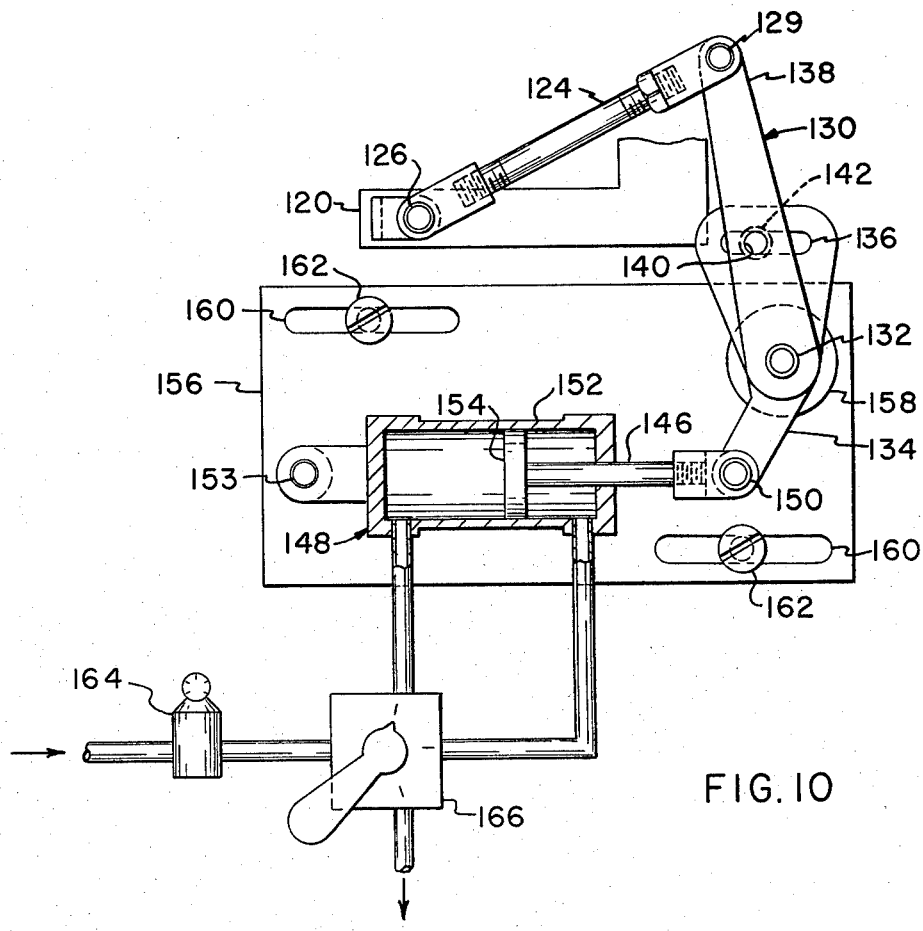
FIG. 10 is a view taken on line X—X of FIG. 2.

Work roll 27 (FIGS. 1 & 4) preferably has a cylindrical rubber surface and is keyed to a shaft 94 rotatable in bearings 96 supported in bracket 98 which has spaced flanges 100 with aligned holes 102 therethrough. A pivot pin 104 extends through holes 102 into bearings 106 attached to arms 108 of a slide 110 having a pair of spaced apart sleeves 112 at one end which each receives a ball bushing shaft 114 (FIGS. 4 & 5) with the ball bushing 115 being between the shaft and sleeve. The ends of shafts 114 are fastened to shaft brackets 116 secured to the housing 2. A bracket 118 is secured to slide 110 between the sleeves 112. The bracket 118 has an arm 120 at its outer end with a hole 122 therein. A link 124 (FIGS. 3,5 & 9) has one end pivotally connected to bracket 118 by means of a pin 126 passing through hole 122 and hole 128 in link 124. The other end of link 124 is pivotally connected to the end of one arm of a two-armed lever 130 by means of pin 131. The lever 130 is pivotally mounted on shaft 132. While lever 130 may be in one piece it is preferred that it be made as shown so that the angle between its arms may be varied. As shown the lever 130 includes a two-armed member 134 pivoted on shaft 132 and having a slot 136 in its upper arm. An arm 138 is movably mounted on shaft 132 and has a hole 140 therein aligned with slot 136. The arm 138 may be moved about shaft 132 with respect to member 134 and then secured to member 134 by means of fastening means 142 such as a cap bolt. The other end of member 134 is pivotally secured to piston rod 146 of air motor 148 by means of pin 150. The motor 148 is standard including a cylinder 152 in which slides a piston 154 connected to piston rod 146. The end of cylinder 152 remote from the piston rod is pivotally connected by means of pivot pin 153 to a mounting plate 156 supported on housing 2. The mounting plate 156 includes a sleeve 158 for supporting shaft 132, sleeve 159 for supporting pin 153, and has horizontal slots 160. The plate 156 is adjustably secured to housing 2 by means of locking bolts 162 passing through slots 160. Air from a power source passes through a pressure regulator 164 (FIG. 10) and four-way valve 166 to the pivoted end of cylinder 148 and from the other end through valve 166 to exhaust.

A cover plate 167 is attached to housing 2 with cap bolt 168 to permit access for maintenance.

Figure 11:
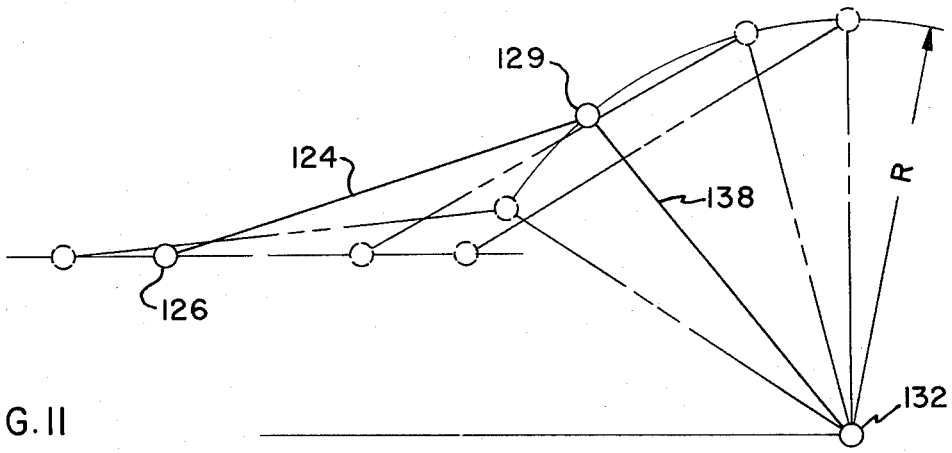
FIG. 11 is a diagrammatic view of the linkage mechanism showing various positions thereof for force multiplication.

In operation an elongated workpiece W having a noncircular cross section is mounted for rotation about its longitudinal axis A. If necessary the housing 2 may be moved about the axis of shaft 10 to aline the work roll 27 with the workpiece so that the axes of the workpiece and work roll are parallel. The motor 36 is then started and air supplied to cylinder 152 which holds the work roll 27 against the workpiece W as it rotates. It will be seen that the workpiece W will cause the work roll 27 to move inwardly the maximum amount when the corners bear against it. Without my improvement this would cause the maximum pressure to be applied because the angle of the belt will be steeper. Such pressure is undesirable because it will most often cause damage to the corners. With my device this greater force normally exerted by the work roll is more than overcome and the force will decrease as the work roll moves away from the axis of the workpiece and increase as it moves toward the axis of the workpiece. The operation is similar to that of applying a force with one's arm. When the arm is straight a maximum force can be applied, but the force will decrease the more the arm is bent. FIG. 11 shows various positions of the linkage mechanism for force multiplication to provide different grinding pressures. Variation in pressure can be obtained by changing the position of plate 156 and/or by changing the angle between the arms of lever 130. While my improved grinder may be used to grind circular workpieces simpler apparatus can be used for that purpose.

While the linkage mechanism may be omitted and the air cylinder 154 arranged with its position rod connected directly to bracket 118 at an angle similar to that of link 124 such arrangement is not as satisfactory as that shown.

While one embodiment has been shown and described it will be apparent that other modifications and adaptations may be made within the scope of the following claims.

I claim:

1. A belt grinder for grinding a workpiece mounted for rotation on a longitudinal axis and having a non-circular cross-section which comprises three rotatable rolls mounted on axes substantially parallel to each other, said rolls being arranged in a triangular manner with one of said rolls being the work roll and the other two being non-work rolls, an abrasive belt passing around said rolls, means for rotating said rolls to drive set abrasive belt, means mounting said work roll for substantially straight line movement toward and away from the axes of said workpiece, said non-work rolls being movable toward and away from each other as the work roll moves toward and away from the axis of said workpiece, and resilient means for applying a force to urge said work roll and belt against said workpiece with the force increasing as the work roll moves toward the axis of said workpiece, said work roll being movable away from the axis of said workpiece by said workpiece when the distance of the surface of said workpiece from its axis increases.

2. A belt grinder according to claim 1 in which said means mounting said work roll includes a slidably bracket on which said work roll is mounted, and a pair of spaced apart guides extending substantially parallel to a line between the axes of said workpiece and work roll for slidably receiving said bracket.

3. A belt grinder according to claim 2 in which said means for applying the force to urge said workpiece and belt against said workpiece includes a fluid motor including a cylinder, a piston slidable in said cylinder and a piston rod extending from said piston at one end, a two-armed lever mounted on a pivot between said arms, means pivotally connecting the end of one arm to the outer end of said piston rod, a link having one end pivotally connected to said bracket and the other end pivotally connected to the outer end of the other arm of said two-armed lever, means for delivering fluid under pressure to one side of said piston to urge said work roll toward said workpiece, and a pressure regulator for controlling the pressure of said fluid.

4. A belt grinder according to claim 3 in which said two-armed lever includes means for varying the angle between the two-arms thereof.

5. A belt grinder according to claim 3 including a housing for supporting said elements of claim 3, a base, means on said base for mounting said housing about an axis substantially in the plane of the axes of said work roll and said workpiece, and means for holding the housing in adjusted position.

6. A belt grinder according to claim 3 including a housing for supporting said elements of claim 3, means on said housing for moving the non-work rolls toward and away from one another, and means for holding the non-work rolls in adjusted position during grinding.

7. A belt grinder according to claim 6 including a base, means on said base for mounting said housing about an axis substantially in the plane of the axes of said work roll and said workpiece, and means for holding the housing in adjusted position.

8. A belt grinder for grinding a workpiece mounted for rotation on a longitudinal axis and having a non-circular cross-section which comprises three rotatable rolls mounted on axes substantially parallel to each other, said rolls being arranged in a triangular manner with one of said rolls being the work roll and the other two being non-work rolls, an abrasive belt passing around said rolls, means for rotating said rolls to drive set abrasive belt, means mounting said work roll for substantially straight line movement toward and away from the axis of said workpiece, said non-work rolls being movable toward and away from each other as the work roll moves toward and away from the axis of said workpiece, and resilient means for applying a force to urge said work roll and belt against said workpiece with the force being applied at an angle to the direction of movement of the work roll with the force increasing as the work roll moves toward the axis of said workpiece, said work roll being movable away from the axis of said workpiece by said workpiece when the distance of the surface of said workpiece from its axis increases.

9. A belt grinder according to claim 8 in which said means mounting said workroll includes a slidable bracket on which said work roll is mounted, and a pair of spaced apart guides extending substantially parallel to a line between the axes of said workpiece and work roll for slidably receiving said bracket.

10. A belt grinder according to claim 9 in which said means for applying the force to urge said workpiece and belt against said workpiece includes a fluid motor including a cylinder, a piston slidable in said cylinder and a piston rod extending from said piston at one end, a two-armed lever mounted on a pivot between said arms, means pivotally connecting the end of one arm to the outer end of said piston rod, a link having one end pivotally connected to said bracket and the other end pivotally connected to the outer end of the other arm of said two-armed lever, means for delivering fluid under pressure to one side of said piston to urge said work roll toward said workpiece, and a pressure regulator for controlling the pressure of said fluid.

* * * * *